US012528630B2

(12) United States Patent
Hong et al.

(10) Patent No.: US 12,528,630 B2
(45) Date of Patent: Jan. 20, 2026

(54) DISPENSER FOR RAZOR CARTRIDGES

(71) Applicant: DORCO CO., LTD., Yongin-si (KR)

(72) Inventors: Seung Yeol Hong, Yongin-si (KR); Su Jin Shin, Seoul (KR)

(73) Assignee: Dorco Co., Ltd., Yongin-si (KR)

( * ) Notice: Subject to any disclaimer, the term of this patent is extended or adjusted under 35 U.S.C. 154(b) by 0 days.

(21) Appl. No.: 18/598,385

(22) Filed: Mar. 7, 2024

(65) Prior Publication Data

US 2024/0208706 A1 Jun. 27, 2024

Related U.S. Application Data

(63) Continuation of application No. PCT/KR2022/012586, filed on Aug. 23, 2022.

(30) Foreign Application Priority Data

Sep. 8, 2021 (KR) ..... 10-2021-0119797

(51) Int. Cl.
*B65D 83/10* (2006.01)
*B65D 71/72* (2006.01)

(52) U.S. Cl.
CPC ..... *B65D 71/72* (2013.01)

(58) Field of Classification Search
CPC ..... B65D 25/105; B65D 71/72; B65D 83/10; A45D 27/225; A45D 27/22; A45D 27/24; B26B 21/24

(Continued)

(56) References Cited

U.S. PATENT DOCUMENTS 2,426,899 A * 9/1947 Pantalone ..... B65D 5/504 493/162
3,879,844 A * 4/1975 Griffiths ..... B26B 21/54 30/41.7

(Continued)

FOREIGN PATENT DOCUMENTS

JP 2006-232325 A 9/2006
JP 2012-505710 A 3/2012

(Continued)

OTHER PUBLICATIONS

International Search Report and Written Opinion mailed Dec. 14, 2022 in International Application No. PCT/KR2022/012586, in 9 pages. *English translation of ISR.*

(Continued)

*Primary Examiner* — Luan K Bui
(74) *Attorney, Agent, or Firm* — Knobbe, Martens, Olson & Bear, LLP

(57) ABSTRACT

A dispenser for razor cartridges is proposed. The dispenser may include a base unit and a pair of cartridge fixing units formed on both sides of the base unit. The base unit and the cartridge fixing units may be made of a bendable sheet of an eco-friendly material. Each fixing unit may include: a first side wall bent from the base unit and having a predetermined height, an upper wall bent and extending from one end of the first side wall, and a second side wall extending from one end of the upper wall toward the base unit and configured to contact the base unit. Each fixing unit may also include at least one cutout portion formed across the upper wall and the second side wall by cutting at least a portion of the upper and second side walls and configured to fix a razor cartridge at an inclined angle.

12 Claims, 12 Drawing Sheets

(58) Field of Classification Search
USPC ..... 206/352–357, 485
See application file for complete search history.

(56) References Cited

U.S. PATENT DOCUMENTS

| | | | | |
|---|---|---|---|---|
| 4,285,428 | A | 8/1981 | Beddall et al. | |
| 4,450,965 | A * | 5/1984 | Paillet | B65D 5/504 206/443 |
| 5,361,907 | A * | 11/1994 | Mohrhauser | B65D 5/5021 206/443 |
| 8,584,848 | B1 * | 11/2013 | Lee | B65D 83/10 30/40 |
| 8,727,126 | B2 * | 5/2014 | Monti | B65D 5/48018 206/766 |
| 2020/0039681 | A1 | 2/2020 | Monti | |

FOREIGN PATENT DOCUMENTS

| | | | |
|---|---|---|---|
| KR | 10-2009-0118127 | A | 11/2009 |
| KR | 10-1802702 | B1 | 11/2017 |
| KR | 10-2019-0102006 | A | 9/2019 |
| WO | WO 1998/036879 | A1 | 8/1998 |

OTHER PUBLICATIONS

Office Action dated Dec. 15, 2022 in Korean Application No. 10-2021-0119797, in 14 pages.
Extended Search Report dated Jul. 4, 2025 in European Application No. 22867594.8, in 9 pages.

* cited by examiner

DISPENSER FOR RAZOR CARTRIDGES

CROSS-REFERENCE TO RELATED APPLICATION

This is a continuation application of International Patent Application No. PCT/KR2022/012586 filed on Aug. 23, 2022, which claims priority to Korean Patent Application No. 10-2021-0119797 filed on Sep. 8, 2021, the contents of each of which are incorporated by reference herein in their entirety.

BACKGROUND

Technical Field

The present disclosure relates to a dispenser for razor cartridges. More specifically, the present disclosure relates to a dispenser for razor cartridges that can be manufactured using eco-friendly materials.

Description of Related Technology

Razor cartridges are typically not sold individually, but rather in a dispenser, which is a case that can accommodate a plurality of razor cartridges.

SUMMARY

One aspect is a dispenser for razor cartridges that can be manufactured using eco-friendly materials while still providing the same functions as conventional plastic dispensers.

Another aspect is a dispenser for razor cartridges, comprising: a base unit; and a pair of cartridge fixing units formed on both sides of the base unit, wherein the base unit and the cartridge fixing units are made of a bendable sheet of an eco-friendly material, and wherein each of the pair of cartridge fixing units includes: a first side wall bent from the base unit and configured to have a predetermined height relative to the base unit; an upper wall configured to be bent and extend from one end of the first side wall; a second side wall extending from one end of the upper wall toward the base unit and configured to contact the base unit; and at least one cutout portion formed across the upper wall and the second side wall by cutting at least a portion of the upper wall and the second side wall and configured to fix a razor cartridge at an inclined angle with respect to the base unit.

As described above, according to the present embodiment, the dispenser for razor cartridges can be manufactured using eco-friendly materials while still providing the same functions as conventional plastic dispensers.

DETAILED DESCRIPTION

Figure 1:
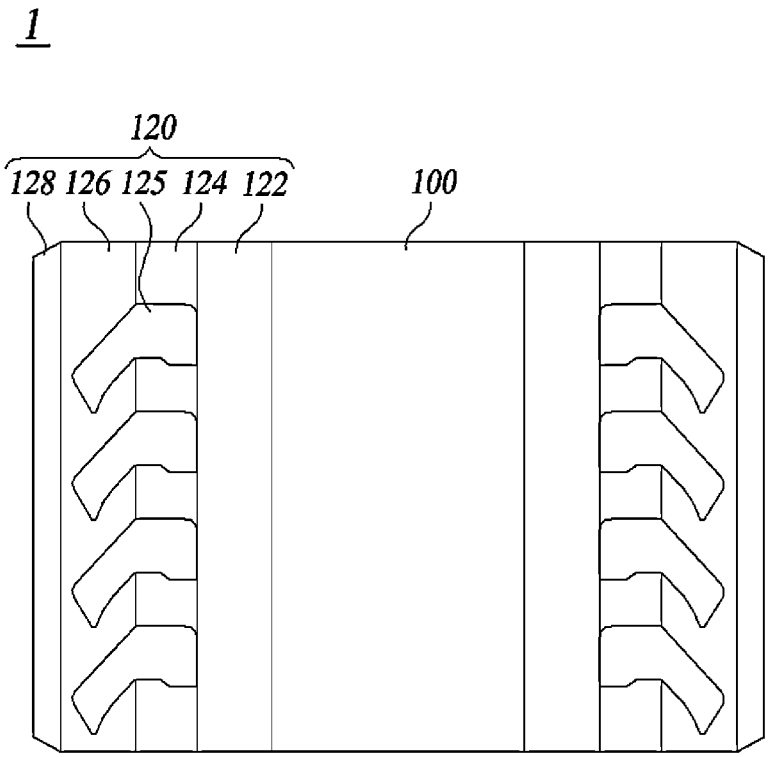
FIG. 1 is a deployed view of a dispenser for razor cartridges according to a first embodiment of the present disclosure.

A user may manually separate the razor cartridge from the dispenser and mount it to a razor handle, but it is also possible to mount the razor handle directly to the razor cartridge contained in the dispenser and then separate it from the dispenser. In addition, in order to directly mount the razor handle to a razor cartridge accommodated in the dispenser, the razor cartridge may be accommodated in the dispenser so that a rear surface of the razor cartridge is visible.

Meanwhile, most dispensers for razor cartridges are made of plastic. However, as regulations and policies to reduce carbon emissions have recently been implemented worldwide, there is a demand for shaving-related products to be manufactured using eco-friendly materials. Therefore, there is a need for dispensers for razor cartridges to be manufactured using eco-friendly materials.

Hereinafter, some embodiments of the present disclosure will be described in detail with reference to the accompanying illustrative drawings. In the following description, like reference numerals preferably designate like elements, although the elements are shown in different drawings. Further, in the following description of some embodiments, a detailed description of related known components and functions when considered to obscure the subject of the present disclosure will be omitted for the purpose of clarity and for brevity.

Additionally, various ordinal numbers or alpha codes such as first, second, i), ii), a), b), etc., may be prefixed. These numbers and codes are solely used to differentiate one component from the other but not to imply or suggest the substances, order, or sequence of the components. Throughout this specification, when a part "includes" or "comprises" a component, the part is meant to further include other components, not to exclude thereof unless specifically stated to the contrary.

FIG. 1 is a deployed view of a dispenser for razor cartridges according to a first embodiment of the present disclosure.

Figure 2:
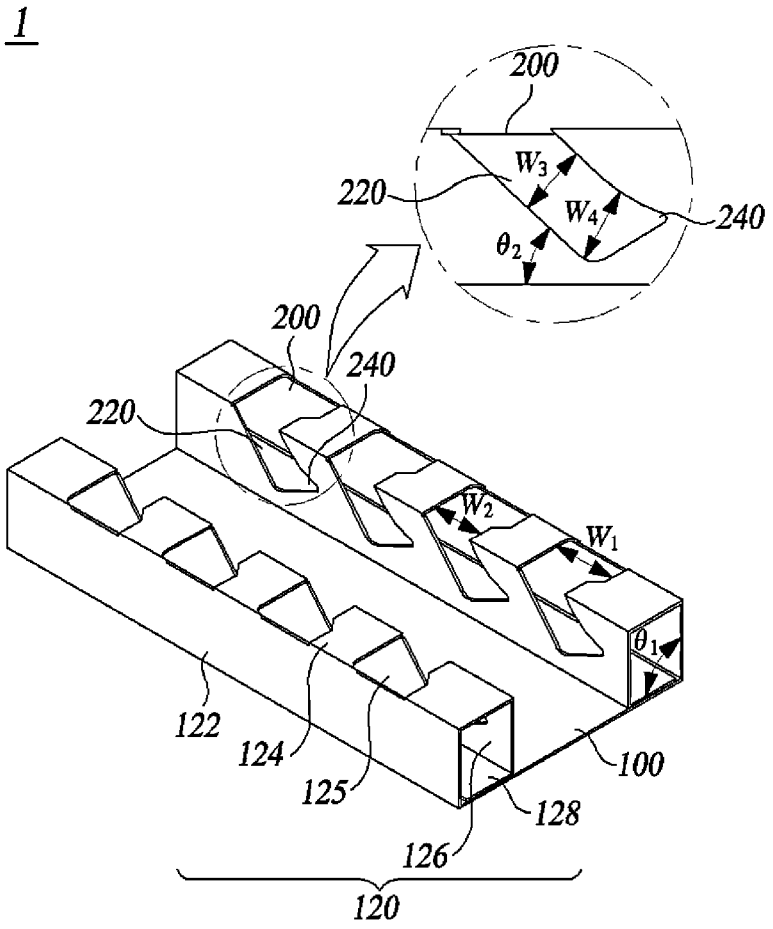
FIG. 2 is a perspective view and a partially enlarged view of the dispenser for razor cartridges according to the first embodiment of the present disclosure.

FIG. 2 is a perspective view and a partially enlarged view of the dispenser for razor cartridges according to the first embodiment of the present disclosure.

Referring to FIGS. 1 and 2, a dispenser for razor cartridges 1 according to the first embodiment of the present disclosure includes a base unit 100 and a pair of cartridge fixing units 120. The pair of cartridge fixing units 120 is formed on both sides of the base unit 100, wherein the cartridge fixing units are preferably configured to be symmetrical to each other.

The base unit 100 and the pair of cartridge fixing units 120 are made of a bendable, eco-friendly material. In this case, the eco-friendly material may be paper, for example, but is not necessarily limited to paper as long as the material is bendable and can satisfy regulations on carbon emissions.

In addition, the base unit 100 and the pair of cartridge fixing units 120 may be made of a single sheet. For example, as shown in FIG. 1, the base unit 100 may be formed in the center of a single sheet, and the pair of cartridge fixing units 120 may be disposed on both sides of the single sheet. Further, when the base unit 100 and the pair of cartridge fixing units 120 are made of paper, at least one side may be coated to improve durability.

However, it is not necessary that the base unit 100 and the pair of cartridge fixing units 120 be made of a single sheet, and each may be manufactured separately and the pair of cartridge fixing units 120 may be joined to the base unit 100.

Hereinafter, the pair of cartridge fixing units 120 will be described in detail.

Each of the pair of cartridge fixing units 120 includes all or part of a first side wall 122, an upper wall 124, a second side wall 126, an adhesive wall 128, and a cutout portion 125.

The first side wall 122 is bent from the base unit 100 to have a predetermined height relative to the base unit 100. The predetermined height is preferably set to be equal to or greater than a vertical height of a razor cartridge 30 (FIG. 3) from one end of the razor cartridge received in the dispenser 1 for razor cartridges according to the first embodiment of the present disclosure with respect to the base unit 100.

Meanwhile, although the extension direction of the first side wall 122 is configured to be perpendicular to the base unit 100 in FIG. 2, but the present disclosure is not necessarily limited thereto. For example, an angle θ1 formed between the extension direction of the first side wall 122 and the base unit 100 may be 90° to 110°.

The upper wall 124 is configured to be bent and extend from one end of the first side wall 122. Although the upper wall 124 is configured to extend in a direction parallel to the base unit 100 in FIG. 2, but the present disclosure is not necessarily limited thereto.

The second side wall 126 is configured to extend from one end of the upper wall 124 toward the base unit 100 to contact the base unit 100. Although the extension direction of the second side wall 126 is configured to be parallel to the extension direction of the first side wall 122 and perpendicular to the base unit 100 in FIG. 2, but the present disclosure is not necessarily limited thereto.

As the second side wall 126 is configured to contact the base unit 100, the pair of cartridge fixing units 120 protrudes from the base unit 100 while the inside thereof may be empty.

The adhesive wall 128 is configured to be bent and extend from one end of the second side wall 126 and to adhere to the base unit 100. To adhere to the base unit 100, the adhesive wall 128 is preferably configured to extend from the second side wall 126 in a direction parallel to the base unit 100 and make surface contact with the base unit 100.

The adhesive wall 128 may be adhered to the base unit 100 through adhesive bonding, and in this case, the pair of cartridge fixing units 120 can firmly fixed to the base unit 100, thereby improving durability. However, the adhesive method is not necessarily limited to bonding adhesion, and various adhesive methods are possible as long as the adhesive method does not weaken the lifespan and durability of the eco-friendly material.

However, it is not necessary that the pair of cartridge fixing units 120 include the adhesive wall 128. For example, a protruding portion (not shown) protruding from one end of the second side wall 126 may be inserted and fixed in a groove (not shown) formed in the base unit 100 without the adhesive wall 128.

The cutout portion 125 is formed across the upper wall 124 and the second side wall 126 by cutting at least a portion of the upper wall 124 and the second side wall 126. One or more cutout portions 125 may be formed in each of the pair of cartridge fixing units 120, and the number of razor cartridges 30 that can be accommodated may be determined depending on the number of cutout portions 125. For example, when four cutout portions 125 are formed in each cartridge fixing unit 120, the dispenser 1 for razor cartridges according to the first embodiment of the present disclosure can accommodate up to four razor cartridges 30.

In addition, as the cutout portion 125 is formed in the state that the inside of the pair of cartridge fixing units 120 is empty, the razor cartridge 30 can be accommodated in the pair of cartridge fixing units 120, for example, by being inserted from the upper wall 124 and fitted into the second side wall 126.

Figure 3:
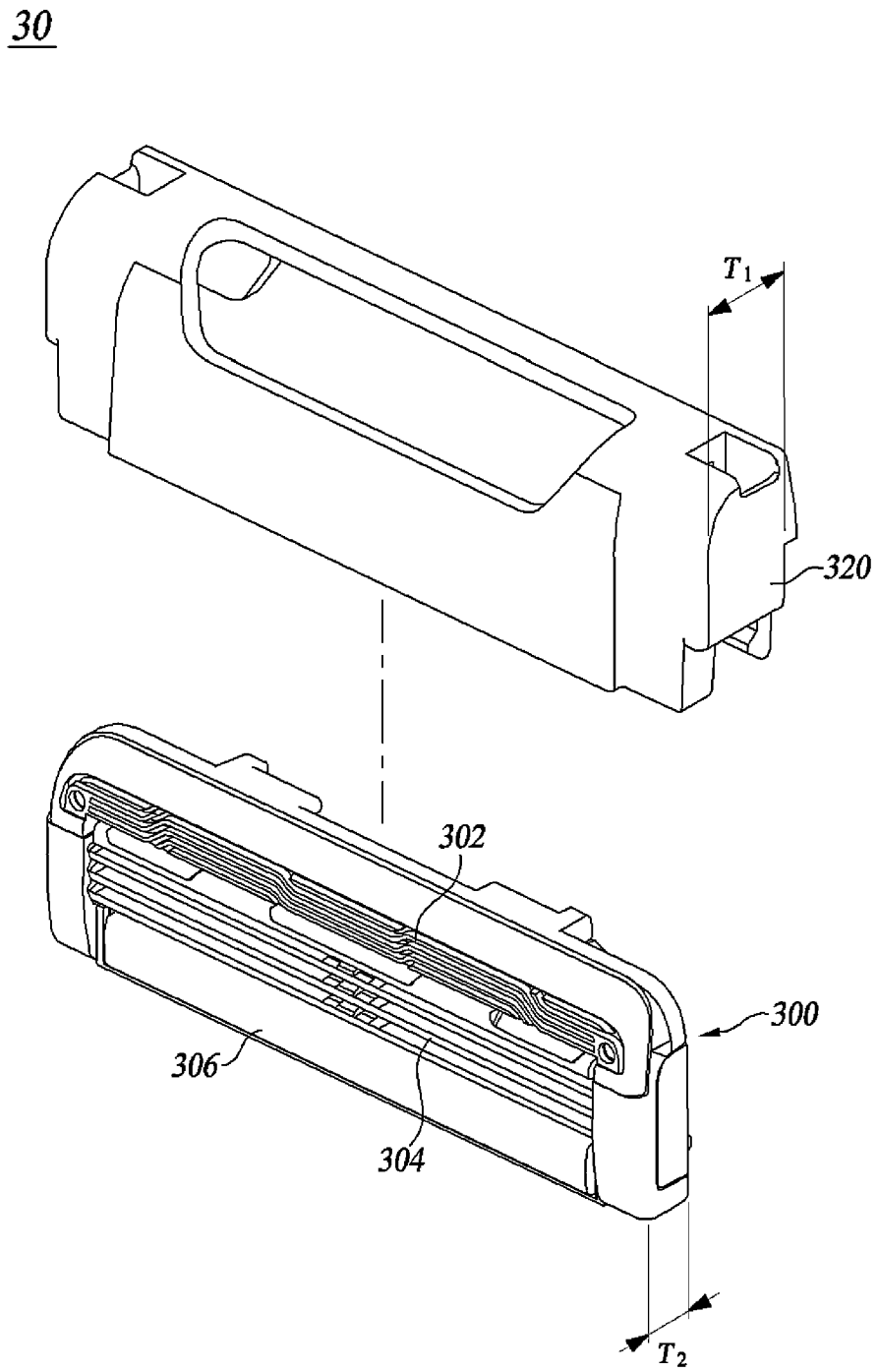
FIG. 3 is a front exploded perspective view of a razor cartridge coupled to a dispenser for razor cartridges according to one embodiment of the present disclosure.

FIG. 3 is a front exploded perspective view of the razor cartridge coupled to the dispenser for razor cartridges according to the first embodiment of the present disclosure.

Figure 4:
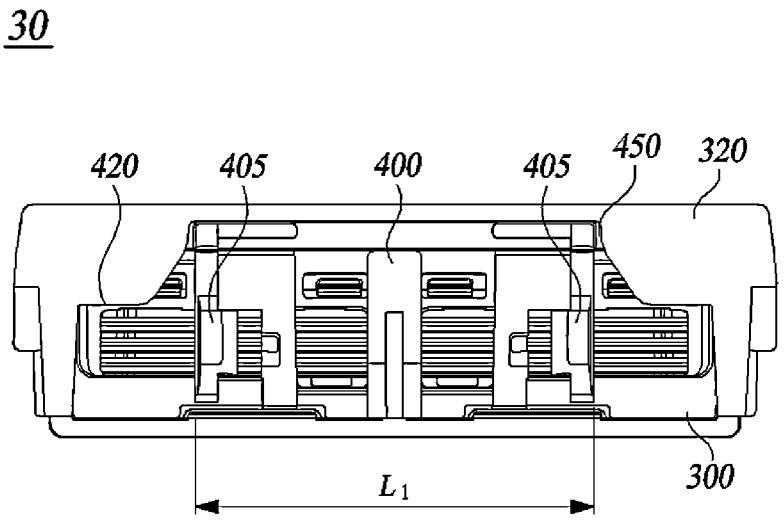
FIG. 4 is a rear perspective view of the cartridge coupled to the dispenser for razor cartridges according to one embodiment of the present disclosure.

FIG. 4 is a rear perspective view of the cartridge coupled to the dispenser for razor cartridges according to one embodiment of the present disclosure.

Referring to FIGS. 3 and 4, the razor cartridge 30 coupled to the dispenser 1 for razor cartridges according to the first embodiment of the present disclosure may include a housing 300 and a protective cap 320.

The housing 300 is a part that comes into contact with a user's skin during actual shaving, and may include a plurality of razor blades 304, a guard 302, a cap 306, and a connector 400.

The plurality of razor blades 304 have cutting edges extending in a longitudinal direction thereof, and the cutting edges are configured to cut the user's body hair during shaving.

The guard 302 is disposed forward of the plurality of razor blades 304. In this case, forward and rearward of the plurality of razor blades 304 are defined based on the shaving direction of the razor cartridge 30. The guard 302 may stretch the skin before the body hair is cut by the plurality of razor blades 304 during shaving.

The cap 306 is disposed rearward of the plurality of razor blades 304. A lubrication band may be placed on the cap 306, and since the lubrication band may contain a lubricating material, it may serve to protect the user's skin when shaving.

The connector 400 is a part where a razor handle (not shown) is coupled. The connector 400 may be formed integrally with the razor cartridge 30, but is not necessarily limited thereto and may be formed as a separate structure to be coupled to the razor cartridge 30.

In addition, the connector 400 may be configured to be fixed relative to the razor cartridge 30, but is not necessarily limited thereto and may be configured to be pivotable relative to the razor cartridge 30.

Referring to FIG. 4, the connector 400 protrudes from the rear of the razor cartridge 30, and the connector 400 is configured to include a pair of handle coupling portions 405, but is necessarily limited to thereto.

The protective cap 320 is configured to surround at least a portion of the front and rear surfaces of the razor cartridge 30. The protective cap 320 can protect the razor cartridge 30 from external shock or contamination, and prevent the skin from coming into direct contact with the plurality of razor blades 304 when the user separates the razor cartridge 30 from the dispenser.

The protective cap 320 may include a separation prevention portion 420 configured to engage with at least a portion of an inlet portion 200 to be described later when the razor cartridge 30 is moved in a direction opposite to the insertion direction of the razor cartridge 30 after it is fixed to the pair of cartridge fixing units 120.

In addition, the razor cartridge 30 may include a gap 450 formed between the connector 400 and the protective cap 320. This is to allow the second side wall 126 to fit into the gap 450 when the razor cartridge 30 is fixed to the pair of cartridge fixing units 120. The gap 450 is preferably formed at the rear surface of the razor cartridge 30, but is not necessarily limited thereto, and the formation position may change depending on the insertion direction of the razor cartridge 30.

Meanwhile, while the razor cartridge 30 coupled to the dispenser 1 for razor cartridges according to the first embodiment of the present disclosure is shown as including the protective cap 320 in the following drawings, the razor cartridge 30 does not necessarily have to include the protective cap 320.

Hereinafter, a thickness of the razor cartridge 30 means T1 in FIG. 3 when the razor cartridge 30 includes the protective cap 320, and T2 in FIG. 3 when the razor cartridge 30 does not include the protective cap 320.

In addition, hereinafter, in the case where the razor cartridge 30 includes the protective cap 320, the front and rear surfaces of the razor cartridge 30 mean the front and rear surfaces of the razor cartridge 30 including the housing 300 and the protective cap 320, and in the case where the razor cartridge 30 does not include the protective cap 320, the front and rear surfaces of the razor cartridge 30 mean the front and rear surfaces of the housing 300.

The above description of the razor cartridge 30 coupled to the dispenser 1 for razor cartridges according to the first embodiment of the present disclosure can be equally applied to the razor cartridge 30 coupled to a dispenser 2 for razor cartridges according to a second embodiment of the present disclosure to be described later.

Figure 5:
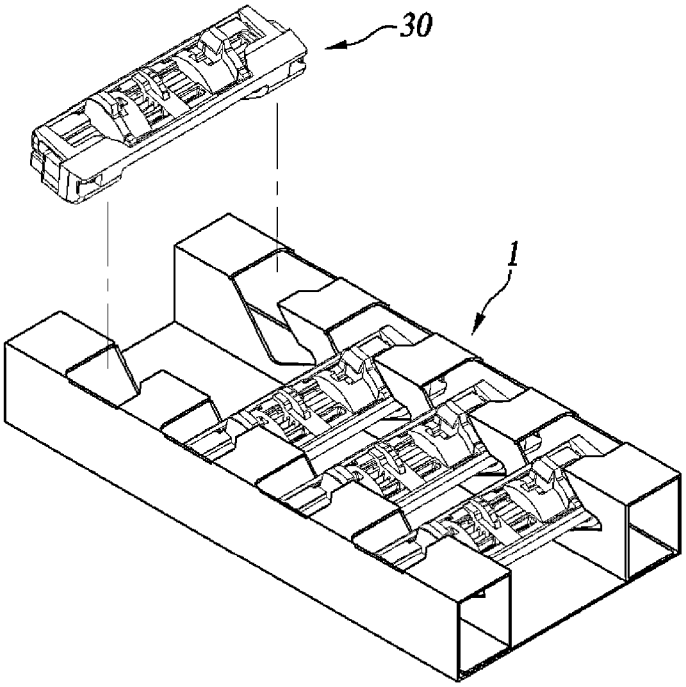
FIG. 5 is a perspective view showing an example of the razor cartridge being coupled to the dispenser for razor cartridges according to the first embodiment of the present disclosure.

FIG. 5 is a perspective view showing an example of the razor cartridge being coupled to the dispenser for razor cartridges according to the first embodiment of the present disclosure.

Figure 6:
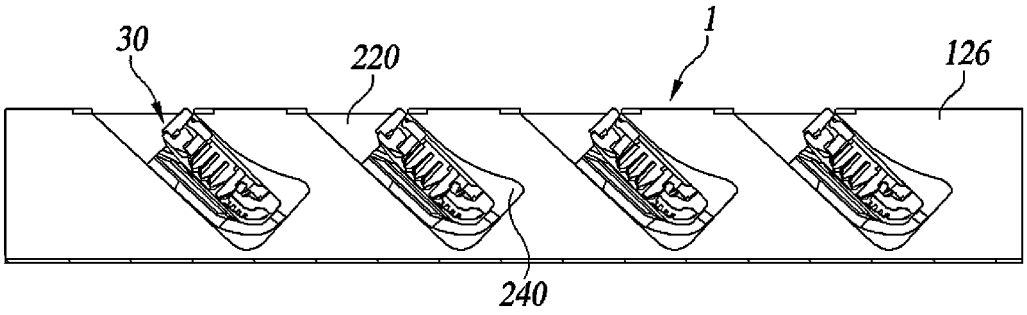
FIG. 6 is a side cross-sectional view showing an example of the razor cartridge being coupled to the dispenser for a razor cartridge according to the first embodiment of the present disclosure.

FIG. 6 is a side cross-sectional view showing an example of the razor cartridge being coupled to the dispenser for a razor cartridge according to the first embodiment of the present disclosure.

Figure 7:
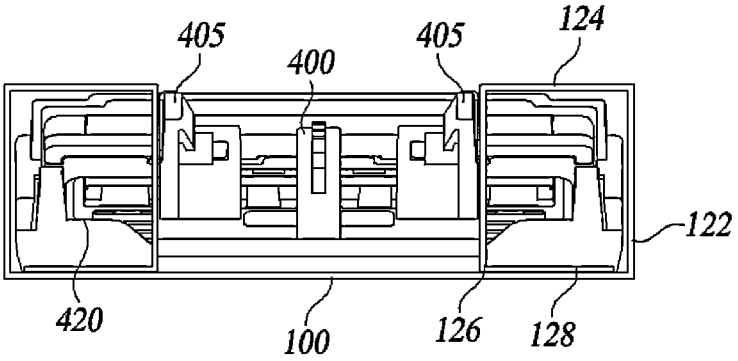
FIG. 7 is a rear view showing an example of the razor cartridge being coupled to the dispenser for a razor cartridge according to the first embodiment of the present disclosure.

FIG. 7 is a rear view showing an example of the razor cartridge being coupled to the dispenser for a razor cartridge according to the first embodiment of the present disclosure.

Referring to FIGS. 2 to 7, the cutout portion 125 is configured to fix the razor cartridge 30 at an inclined angle with respect to the base unit 100, which promotes stable storage of the razor cartridge 30 and facilitates coupling of the razor handle to the razor cartridge 30.

Accordingly, the razor cartridge 30 may be fixed to the pair of cartridge fixing units 120 such that the rear surface thereof is exposed, wherein the guard 302 and the cap 306 may be configured to be disposed at the lower and upper sides, respectively.

As described above, the second side wall 126 may be configured to fit into the gap 450 while the razor cartridge 30 is fixed to the pair of cartridge fixing units 120.

In addition, when the connector 400 includes the pair of handle coupling portions 405, the pair of cartridge fixing units 120 may be formed spaced apart by a distance between the pair of handle coupling portions 405, for example, by L1 or by L1 or more in FIG. 4. That is, the position where the pair of cartridge fixing units 120 are formed may change depending on the distance between the pair of handle coupling portions 405 in the razor cartridge 30.

In this case, the second side wall 126 may come into contact with one surface of the connector 400 while the razor cartridge 30 is fixed to the pair of cartridge fixing units 120. Accordingly, the second side wall 126 can guide the razor cartridge 30 when the razor cartridge 30 is inserted into the pair of cartridge fixing units 120. However, the second side wall 126 is not necessarily configured to contact one surface of the connector 400.

Meanwhile, referring again to FIGS. 2 to 7, the cutout portion 125 may include an inlet portion 200, a slide portion 220, and a hooking portion 240.

The inlet portion 200 is formed by cutting at least a portion of the upper wall 124, and may be configured to have a width in the longitudinal direction of the upper wall 124 equal to or greater than the thickness, e.g., T1, of the razor cartridge 30.

For example, the insertion of the razor cartridge 30 may be started in a state in which one of the front and rear surfaces of the razor cartridge 30 is in contact with the upper wall 124, or both the front and rear surfaces of the razor cartridge 30 are not in contact with the upper wall 124. Accordingly, when the razor cartridge 30 is inserted from the inlet portion 200, natural insertion may be made, and the insertion direction of the razor cartridge 30 may not be restricted.

In addition, referring to FIG. 2, the inlet portion 200 is configured so that a first width W1 of a region adjacent to the first side wall 122 is wider than a second width W2 of a region adjacent to the second side wall 126. In this case, the first width W1 and the second width W2 refer to the width in the longitudinal direction of the upper wall 124.

Therefore, in the case that the protective cap 320 includes the separation prevention portion 420, one end of the region with the second width W2 may be configured to engage with the protective cap 320 when the razor cartridge 30 is moved in a direction opposite to the insertion direction of the razor cartridge 30 after it is fixed to the pair of cartridge fixing units 120. Accordingly, the razor cartridge 30 can be prevented from being unintentionally separated from the pair of cartridge fixing units 120.

The slide portion 220 is formed by cutting at least a portion of the second side wall 126, and guides the insertion of the razor cartridge 30 so that the razor cartridge 30 can be moved obliquely toward the base unit 100. An angle θ2 formed between the extension direction of the slide portion 220 and the base unit 100 may be about 20° to 40°.

The razor cartridge 30 is inserted through the slide portion 220 after passing through the inlet portion 200. For example, after entering the slide portion 220, the razor cartridge 30 may slide toward the base unit 100 while spanning the second side wall 126.

In this case, a width W3 of the slide portion 220 on the second side wall 126 in the direction perpendicular to the extension direction of the slide portion 220 may be equal to or greater than the thickness, e.g., T1, of the razor cartridge 30.

The hooking portion 240 is configured to extend from the slide portion 220 in a direction different from the extension direction of the slide portion 220. In this case, as the razor cartridge 30 enters the hooking portion 240, its insertion angle may change. Accordingly, the razor cartridge 30 fixed to the pair of cartridge fixing units 120 may not be separated from the pair of cartridge fixing units 120 unless an attempt is made to separate it by applying an artificial force.

When the razor cartridge 30 is fully inserted into the hooking portion 240, the second side wall 126 may be fitted into the gap 450 of the razor cartridge 30, and thus, an angle between the pair of cartridge fixing units 120 and the base unit 100 may not exceed, for example, 110°.

In addition, on the second side wall 126, a width W4 in a direction perpendicular to the extension direction of an end portion of the hooking portion 240 adjacent to the slide portion 220 may be greater than the width W3 in the direction perpendicular to the extension direction of the slide portion 220.

In this case, the razor cartridge 30 can naturally enter the hooking portion 240 through the slide portion 220, and thus the razor cartridge 30 can be naturally fixed. For example, the razor cartridge 30 may be fixed to the pair of cartridge fixing units 120 in a state in which a portion of the razor cartridge 30 hanging over the hooking portion 240 and at least a portion of the remaining portion being inserted into the slide portion 220.

Figure 8:
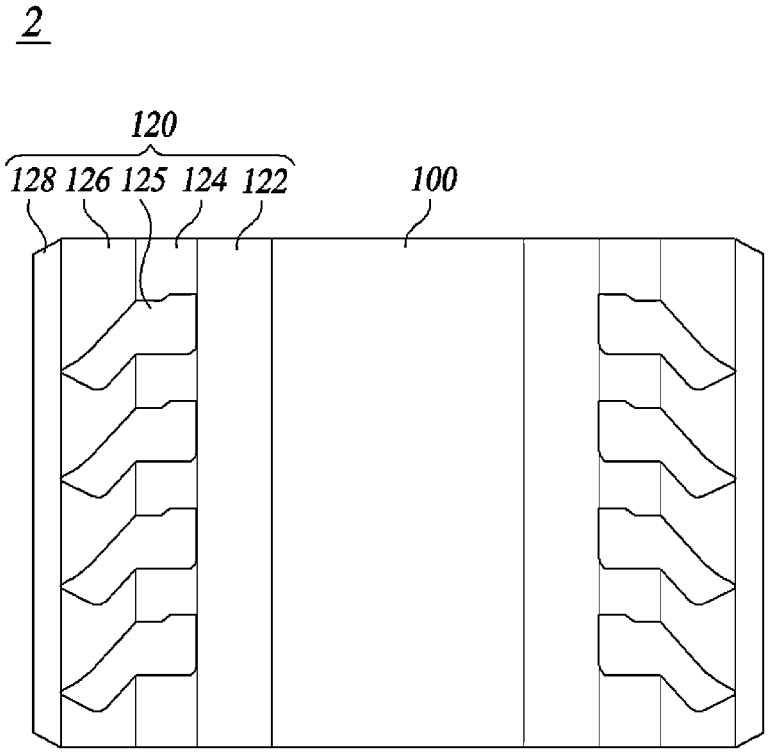
FIG. 8 is a deployed view of a dispenser for razor cartridges according to a second embodiment of the present disclosure.

FIG. 8 is a deployed view of a dispenser for razor cartridges according to a second embodiment of the present disclosure.

Figure 9:
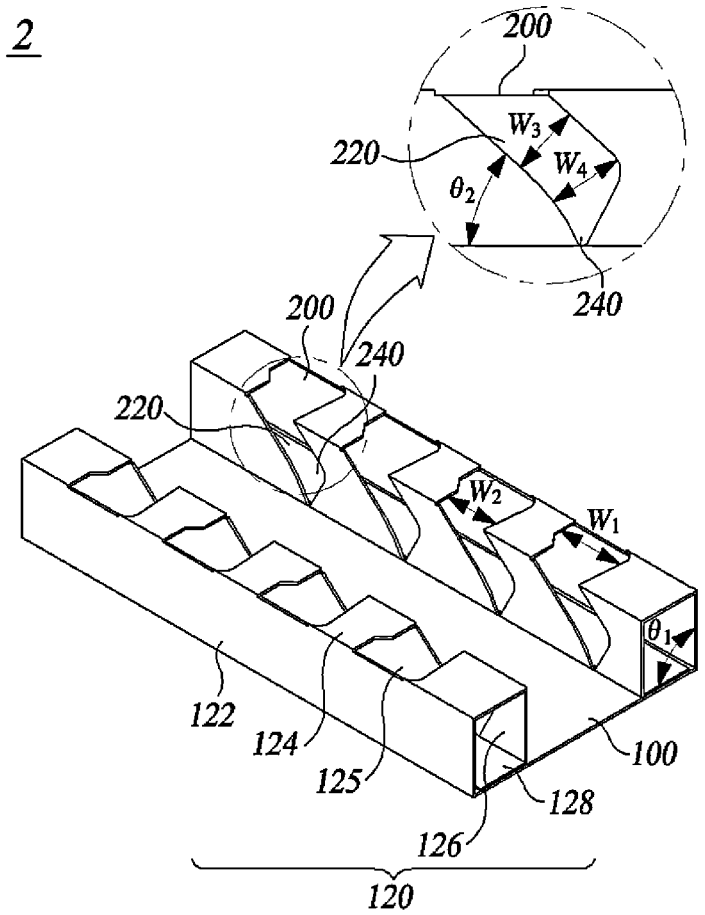
FIG. 9 is a perspective view and a partially enlarged view of the dispenser for razor cartridges according to the second embodiment of the present disclosure.

FIG. 9 is a perspective view and a partially enlarged view of the dispenser for razor cartridges according to the second embodiment of the present disclosure.

Figure 10:
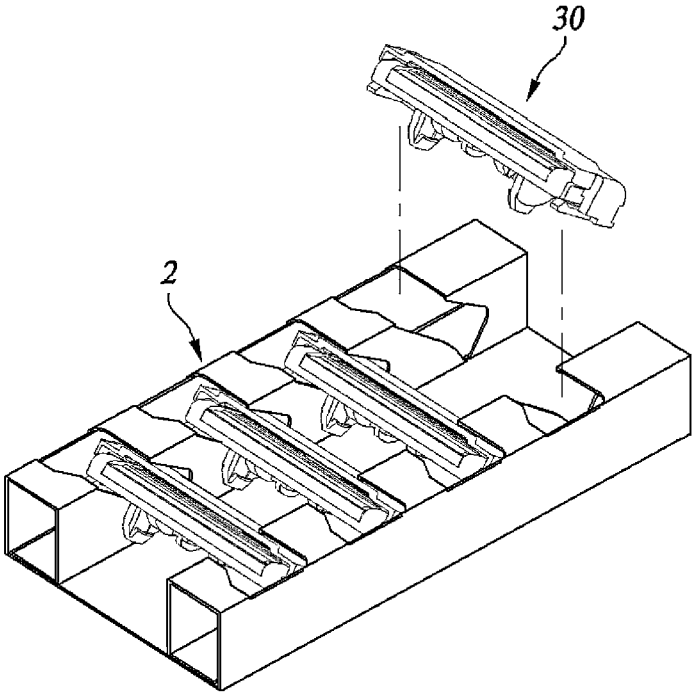
FIG. 10 is a perspective view showing an example of the razor cartridge being coupled to the dispenser for razor cartridges according to the second embodiment of the present disclosure.

FIG. 10 is a view showing an example of the razor cartridge being coupled to the dispenser for razor cartridges according to the second embodiment of the present disclosure.

Figure 11:
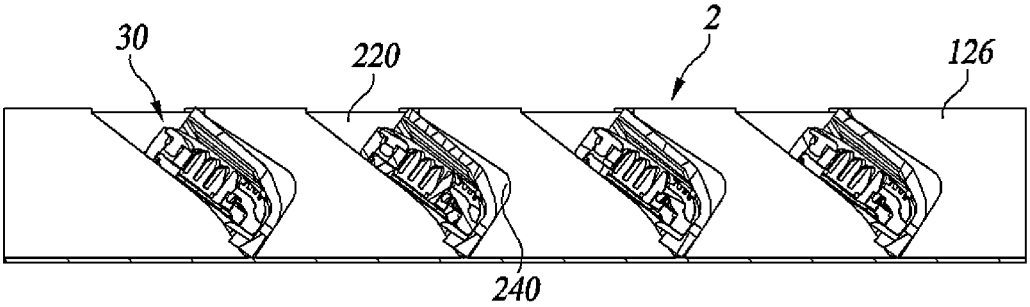
FIG. 11 is a side cross-sectional view showing an example of the razor cartridge being coupled to the dispenser for razor cartridges according to the second embodiment of the present disclosure.

FIG. 11 is a side cross-sectional view showing an example of the razor cartridge being coupled to the dispenser for razor cartridges according to the second embodiment of the present disclosure.

Figure 12:
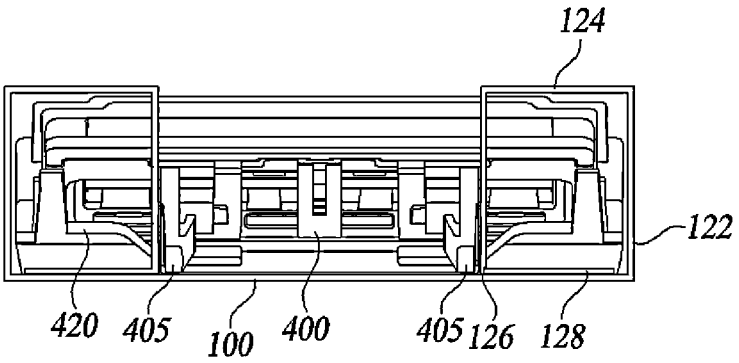
FIG. 12 is a rear view showing an example of the razor cartridge being coupled to the dispenser for razor cartridges according to the second embodiment of the present disclosure.

FIG. 12 is a rear view showing an example of the razor cartridge being coupled to the dispenser for razor cartridges according to the second embodiment of the present disclosure.

Referring to FIGS. 8 to 12, compared to the dispenser 1 for razor cartridges according to the first embodiment of the present disclosure, the dispenser 2 for razor cartridges according to the second embodiment of the present disclosure has a different direction in which the razor cartridge 30 is accommodated.

For example, the razor cartridge 30 may be fixed to the pair of cartridge fixing units 120 such that the front surface thereof is exposed. In this case, the razor cartridge 30 may be configured such that the cap 306 and the guard 302 are disposed at the upper and lower sides, respectively, but the present disclosure is not necessarily limited thereto, and the razor cartridge 30 may be configured such that the cap 306 and the guard 302 are disposed at the lower and upper sides, respectively.

In addition, the hooking portion 240 may be configured to extend from the second side wall 126 until it contacts the base unit 100, but is not necessarily limited thereto, and may extend from the slide portion 220 such that it ends before reaching the base unit 100.

As the dispenser 2 for razor cartridges according to the second embodiment of the present disclosure accommodates the razor cartridge 30 such that the front surface of the razor cartridge 30 is exposed, the user can visually check the status of the razor cartridge 30 and the number of blades and can also easily check for defects during the manufacturing process.

Further, when a user separates the razor cartridge 30 from the dispenser 2 for razor cartridges according to the second embodiment of the present disclosure by hand, the separation direction may be opposite to the direction in which the housing 300 and the protective cap 320 are separated. Therefore, when the user takes out the razor cartridge 30 from the dispenser 2, the protective cap 320 does not easily separate from the housing 300, thereby preventing injuries such as cuts caused by the plurality of razor blades 304.

Figure 13:
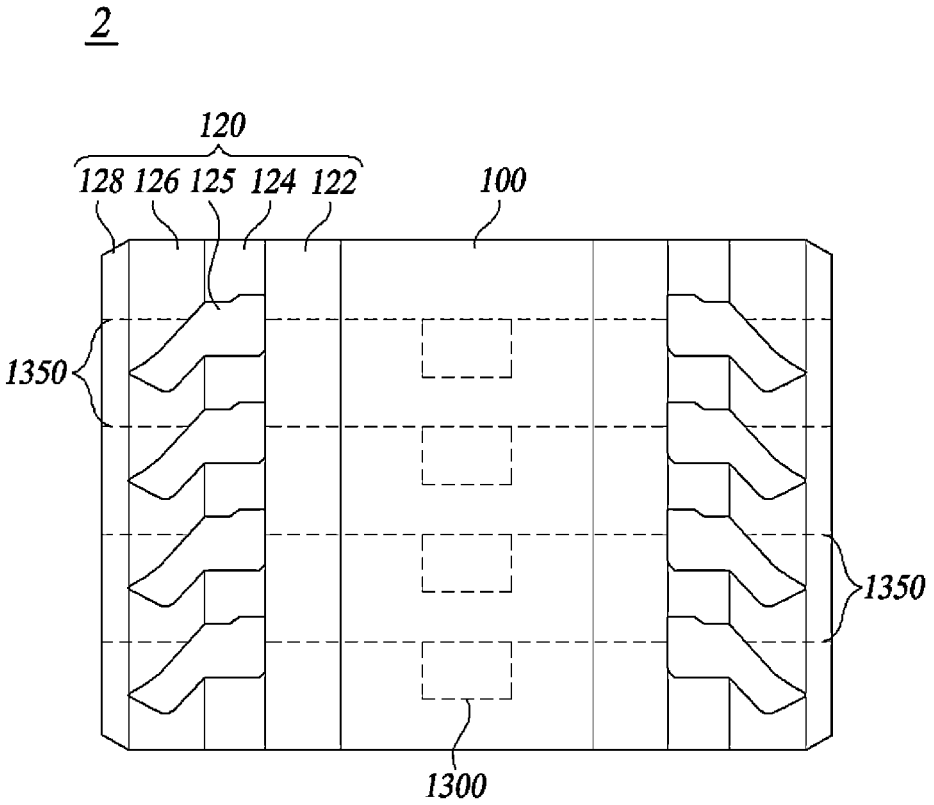
FIG. 13 is a deployed view showing first and second perforated portions of the dispenser for razor cartridges according to the second embodiment of the present disclosure.

FIG. 13 is a deployed view showing first and second perforated portions of the dispenser for razor cartridges according to the second embodiment of the present disclosure.

Figure 14:
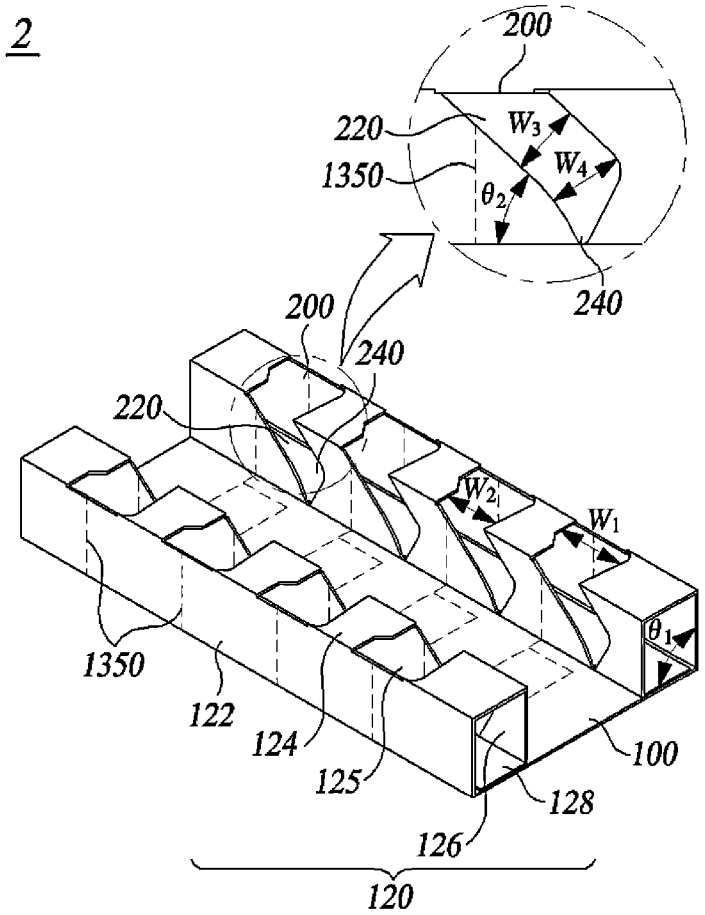
FIG. 14 is a perspective view showing the first and second perforated portions of the dispenser for razor cartridges according to the second embodiment of the present disclosure.

FIG. 14 is a perspective view showing the first and second perforated portions of the dispenser for razor cartridges according to the second embodiment of the present disclosure.

Referring to FIGS. 13 and 14, the base unit 100 may include a first perforated portion 1300 and/or a second perforated portion 1350.

The first perforated portion 1300 is configured to be cut between the pair of cartridge fixing units 120 and has a predetermined area through which at least a portion of the razor handle can penetrate. In this case, the predetermined area is sufficient to allow the front end of the razor handle or a human finger to pass through, and does not necessarily need to be large enough to allow the entire razor handle to pass through.

The first perforated portion 1300 is preferably formed at a position corresponding to the position of the connector 400 while the razor cartridge 30 is fixed to the pair of cartridge fixing units 120. In this case, the user can cut the first perforated portion 1300 to create a space into which the razor handle can be inserted on the rear side of the base unit 100, that is, on the side opposite to the side where the pair of cartridge fixing units 120 is formed. The razor handle may be inserted into the space where the first perforated portion 1300 is cut to be coupled with the razor cartridge 30.

However, the razor handle does not necessarily need to be inserted into the space where the first perforated portion 1300 is cut, and in some cases, the user may insert his or her finger into the space to separate the razor cartridge 30 from the pair of cartridge fixing units 120. In this case, since the user push the rear surface of the razor cartridge 30 up to separate the razor cartridge 30 from the pair of cartridge fixing units 120, it is possible to separate the razor cartridge 30 without direct contact with the plurality of razor blades 304 even when the razor cartridge 30 does not include the protective cap 320.

In addition, the dispenser 2 for razor cartridges according to the second embodiment of the present disclosure does not necessarily include the first perforated portion 1300, and instead of the first perforated portion 1300, an opening portion (not shown) may be formed at the position where the first perforated portion 1300 is formed. The case in which the opening portion is formed may be the same as the case in which the above-described first perforated portion 1300 is cut. Accordingly, the opening portion may perform the same function as the first cutout portion 1300.

The second perforated portion 1350 is formed across at least a portion of the pair of cartridge fixing units 120 and the base unit 100, and is configured to be cut when after the razor handle is coupled to the razor cartridge 30, the razor handle is moved in the opposite direction of the coupling direction. This can increase user convenience when the user wants to use a razor assembly (not shown) in which the razor handle and the razor cartridge 30 are combined.

For example, the user can couple the razor handle to the razor cartridge 30 by inserting the razor handle into the opening portion or the cut space of the first perforated portion 1300. In this case, when the user pulls the razor assembly in a direction opposite to the coupling direction, the second perforated portion 1350 is cut and the user can easily separate the razor assembly from the pair of cartridge fixing units 120.

The dispenser 2 for razor cartridges according to the second embodiment of the present disclosure may be the same as the description of the dispenser 1 for razor cartridges according to the first embodiment except for matters specifically described above, and detailed description thereof will be omitted.

As described above, the dispensers 1 and 2 for razor cartridges according to the embodiments of the present disclosure can be manufactured using eco-friendly materials and can provide the same functions as conventional plastic dispensers.

Although exemplary embodiments of the present disclosure have been described for illustrative purposes, those skilled in the art will appreciate that various modifications, additions, and substitutions are possible, without departing from the defining features by the embodiments. Therefore, exemplary embodiments of the present disclosure have been described for the sake of brevity and clarity. The scope of the technical idea of the embodiments of the present disclosure is not limited by the illustrations. Accordingly, one of ordinary skill would understand the scope of the claimed invention is not to be limited by the above explicitly described embodiments but by the claims and equivalents thereof.

What is claimed is:

1. A dispenser for razor cartridges, comprising:

a base unit; and a pair of cartridge fixing units formed on both sides of the base unit, wherein the base unit and the cartridge fixing units are made of a bendable sheet of an eco-friendly material, and wherein each of the pair of cartridge fixing units includes:

a first side wall bent from the base unit and having a predetermined height relative to the base unit;

an upper wall bent and extending from one end of the first side wall;

a second side wall extending from one end of the upper wall toward the base unit and configured to contact the base unit; and at least one cutout portion formed across the upper wall and the second side wall by cutting at least a portion of the upper wall and the second side wall and configured to fix a razor cartridge at an inclined angle with respect to the base unit, wherein the cutout portion includes a slide portion formed by cutting at least a portion of the second side wall and guides insertion of the razor cartridge to allow the razor cartridge to move obliquely toward the base unit, and wherein the cutout portion further includes a hooking portion configured to extend from the slide portion in a direction different from an extension direction of the slide portion.

2. The dispenser for razor cartridges of claim 1, wherein the cutout portion includes an inlet portion formed by cutting at least a portion of the upper wall and configured such that a width in a longitudinal direction of the upper wall is equal to or greater than a thickness of the razor cartridge.

3. The dispenser for razor cartridges of claim 1, wherein on the second side wall, a width in a direction perpendicular to an extension direction of an end portion of the hooking portion adjacent to the slide portion is greater than a width in a direction perpendicular to the extension direction of the slide portion.

4. The dispenser for razor cartridges of claim 1, wherein the slide portion is formed such that an angle between an extension direction of the slide portion and the base unit is 20° to 40°.

5. The dispenser for razor cartridges of claim 1, wherein the first side wall is formed such that an angle between an extension direction of the first side wall and the base unit is 90° to 110°.

6. The dispenser for razor cartridges of claim 1, wherein the second side wall is configured to fit into a gap formed between a connector protruding from a rear surface of the razor cartridge and a protective cap configured to surround at least a portion of a front surface and the rear surface of the razor cartridge.

7. The dispenser for razor cartridges of claim 1, further comprising:

an adhesive wall bent and extending from one end of the second side wall and to adhere to the base unit.

8. The dispenser for razor cartridges of claim 1, wherein the pair of cartridge fixing units are formed to be spaced apart by a distance between a pair of handle coupling portions included in a connector protruding from a rear surface of the razor cartridge.

9. The dispenser for razor cartridges of claim 2, wherein the inlet portion is configured such that a first width of a region adjacent to the first side wall is wider than a second width of a region adjacent to the second side wall.

10. The dispenser for razor cartridges of claim 9, wherein one end of the region having the second width is configured to engage with a protective cap configured to surround at least a portion of a front surface and a rear surface of the razor cartridge when the razor cartridge is moved in a direction opposite to an insertion direction of the razor cartridge after being fixed to the pair of cartridge fixing units.

11. A dispenser for razor cartridges, comprising:

a base unit; and a pair of cartridge fixing units formed on both sides of the base unit, wherein the base unit and the cartridge fixing units are made of a bendable sheet of an eco-friendly material, and wherein each of the pair of cartridge fixing units includes:

a first side wall bent from the base unit and having a predetermined height relative to the base unit;

an upper wall bent and extending from one end of the first side wall;

a second side wall extending from one end of the upper wall toward the base unit and configured to contact the base unit; and at least one cutout portion formed across the upper wall and the second side wall by cutting at least a portion of the upper wall and the second side wall and configured to fix a razor cartridge at an inclined angle with respect to the base unit, wherein the base unit includes:

a first perforated portion configured to be cut between the pair of cartridge fixing units; or an opening portion formed between the pair of cartridge fixing units, and wherein the first perforated portion or the opening portion has a predetermined area through which at least a portion of a razor handle to be coupled with the razor cartridge penetrates.

12. A dispenser for razor cartridges, comprising:

a base unit; and a pair of cartridge fixing units formed on both sides of the base unit, wherein the base unit and the cartridge fixing units are made of a bendable sheet of an eco-friendly material, and wherein each of the pair of cartridge fixing units includes:

a first side wall bent from the base unit and having a predetermined height relative to the base unit;

an upper wall bent and extending from one end of the first side wall;

a second side wall extending from one end of the upper wall toward the base unit and configured to contact the base unit; and at least one cutout portion formed across the upper wall and the second side wall by cutting at least a portion of the upper wall and the second side wall and configured to fix a razor cartridge at an inclined angle with respect to the base unit, the dispenser further comprising:

a second perforated portion formed across at least a portion of the pair of cartridge fixing units and the base unit, and configured to be cut when after a handle is coupled with the razor cartridge, the handle is moved in a direction opposite to the coupling direction.

* * * * *